United States Patent [19]

Sasser et al.

[11] 4,431,997

[45] Feb. 14, 1984

[54] COMPOUND ELEMENT FOR IMAGE ELEMENT ANTENNAS

[75] Inventors: Bill H. Sasser, Phoenix; Raymond G. Immell, Mesa, both of Ariz.

[73] Assignee: Motorola Inc., Schaumburg, Ill.

[21] Appl. No.: 235,390

[22] Filed: Feb. 18, 1981

[51] Int. Cl.[3] ..... H01Q 13/10; H01Q 19/185

[52] U.S. Cl. ..... 343/770; 343/836

[58] Field of Search ..... 343/770, 836, 837

[56] References Cited

U.S. PATENT DOCUMENTS 2,654,842 10/1953 Engelman ..... 343/770

2,877,427 3/1959 Butler ..... 343/770

OTHER PUBLICATIONS

Von Trentini, "Partially Reflecting Sheet Arrays"; IRE Trans. on Ant. & Prop., Oct. 1956, pp. 661–671.

*Primary Examiner*—Eli Lieberman

*Attorney, Agent, or Firm*—Jonathan P. Meyer; Eugene A. Parsons

[57] ABSTRACT

Image element antennas are well known for their relatively small size and highly directive radiation patterns. Such antennas, however, have an inherent disability in that the mechanism responsible for high directivity is inoperable at a certain angle, thereby producing a sidelobe into which relatively large amounts of power are radiated. The present invention involves an improved element for use in image element antennas which avoids radiating any substantial amounts of power into this sidelobe. A preferred embodiment of the invention provides a doublet element having a minimum of radiated power at the angle of the sidelobe, thus avoiding the need for the multiple reflection-transmission mechanism which fails at this angle.

3 Claims, 13 Drawing Figures

COMPOUND ELEMENT FOR IMAGE ELEMENT ANTENNAS

FIELD OF THE INVENTION

The present invention relates to antennas utilizing multiple reflections between parallel planes to produce multiple images of each driven antenna element, thus enhancing the directivity of the antenna without the addition of more driven elements. More particularly, the invention relates to an improved element for use in such image element antennas which avoids inherent limitations of prior art antennas and thereby further enhances antenna directivity.

BACKGROUND OF THE INVENTION

The principal of image element antennas, also known as partially reflecting sheet arrays, is well known in the art. These antennas are constructed by placing a driven antenna element in a space between two parallel planes. One of the planes is totally reflecting at the antenna frequency and the other is partially reflecting. The multiple reflections between the two planes of the energy radiated by the element, with partial transmission at the partially reflecting plane, produce a radiation pattern directing most of the radiated power in a predetermined direction.

Image element antennas are taught by Giswalt Von Trentini in an article entitled "Partially Reflecting Sheet Arrays" in IRE Transactions on Antennas and Propagation, October 1956, at page 666 and by U.S. Pat. No. 3,990,078, Image Element Antenna Array, For a Monopulse Tracking System For a Missile, Jan. 6, 1975.

Image antennas depend for the increased directivity on destructive interference between the successive rays transmitted by the partially reflecting plane. If, for some reason, the planes do not produce multiple reflections for certain rays emitted by the element, the directivity of the antenna will be decreased.

As is well known, the reflected fraction of the energy incident on a dielectric is a function of the angle of incidence. Specifically, the reflected fraction has a minimum at an angle of incidence known as the Brewster angle. So an image antenna will have greatly increased sidelobes in the radiation pattern centered at the Brewster angle of the dielectric partially reflecting plane. Since one of the purposes of using image antennas is to achieve high directivity, this is a serious limitation.

SUMMARY OF THE INVENTION

Accordingly, it is an object of the present invention to provide an improved image element antenna.

It is a further object of the invention to avoid sidelobes caused by the low reflectivity of the partially reflecting plane at the Brewster angle.

It is also an object of the invention to accomplish the above by providing an improved antenna element for use in image antennas which radiates a minimum amount of power at the Brewster angle.

These and other objects of the invention will be obvious to one skilled in the art upon study of the detailed description below and the drawings.

A particular embodiment of the invention provides an element comprising a pair of slot radiators spaced to radiate a minimum amount of power at the Brewster angle.

BRIEF DESCRIPTION OF THE DRAWINGS

Referring to the drawings, in which like numerals are used to denote like structure throughout.

DETAILED DESCRIPTION OF THE PREFERRED EMBODIMENT

Figure 1:
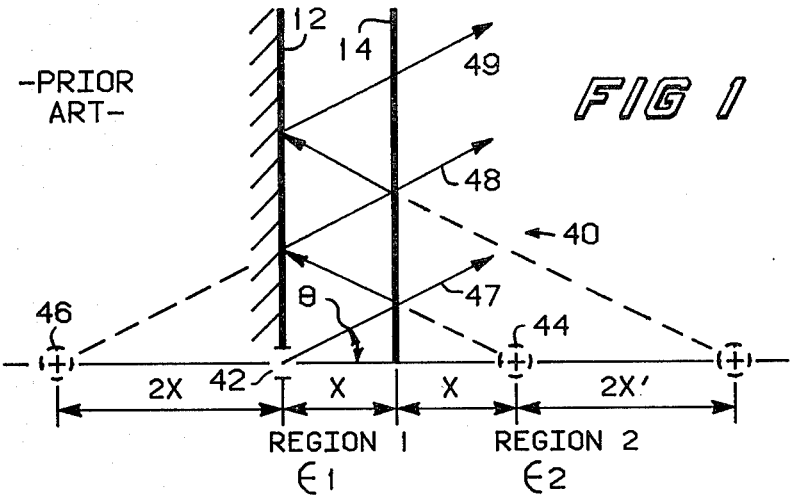
FIG. 1 illustrates diagrammatically a prior art image element antenna.

FIG. 1 shows a diagram of an image element antenna employing a slot radiator 42 as the element. Since the preferred embodiment of the invention is of this type, the drawings and description are drawn to slot elements. However, it is known in the art that other arrangements may be used. The application of the invention to image antennas using other types of radiating elements is intended to be included in the description and claims below.

Referring to FIG. 1, an image element antenna is shown having a totally reflecting plane 12 and a partially reflecting plane 14. The space between the planes, Region 1, has dielectric constant $E_1$ and the region beyond plane 14, Region 2, has dielectric constant $E_2$. Element 42 comprises a slot radiator in plane 12. The use of other types of elements is possible, as long as the element lies in the space between the planes. The interface between the two regions at plane 14 produces partial reflection and transmission of energy radiated from element 42. For the case of energy radiated at angle $\theta$ with respect to the horizontal, rays 47, 48, and 49 are transmitted through plane 14, each with a different phase angle. As is well known, these phase angles will depend on the width X of Region 1 and the angle $\theta$. The differences in the phase angles produces destructive interference between successive rays for large angles $\theta$, thus producing a highly directive antenna. It can be seen by familiar geometric construction that this arrangement produces image elements 44, 46, etc.

Figure 2:
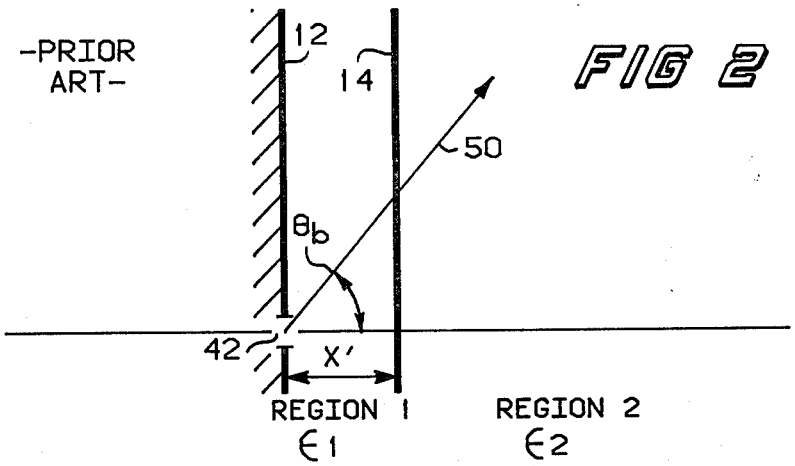
FIG. 2 is a diagram of a prior art image element antenna radiating at the Brewster angle.

Referring now to FIG. 2, the antenna of FIG. 1 is shown for the case of $\theta$ equal to the Brewster angle $\theta b$. As is well known, $\theta b$ is a function of the wavelength of the incident energy and the dielectric constrants $E_1$ and $E_2$. Energy incident on plane 14 at angle $\theta b$ is not partially reflected, but totally transmitted. Since no other rays are emitted at angle $\theta b$ with different phase angles, no interference can take place and substantial power is radiated at the Brewster angle. The elimination of this sidelobe is an aim of this invention.

Figure 3:
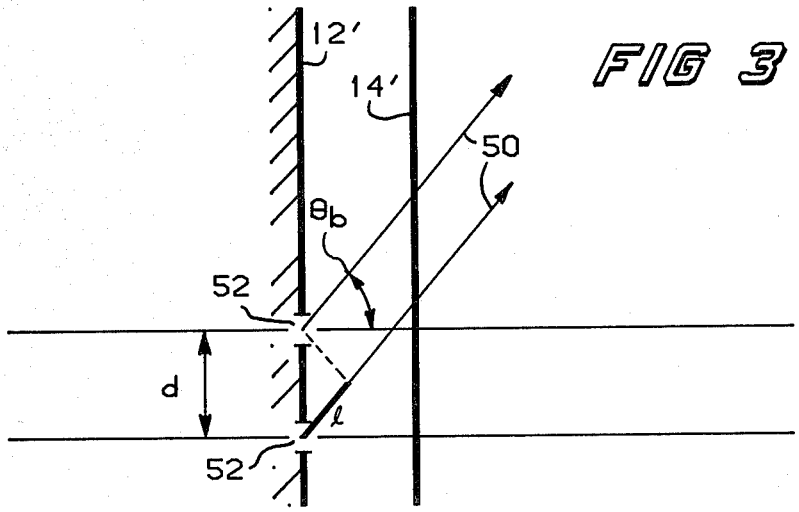
FIG. 3 is a diagram of an image element antenna utilizing an embodiment of the present invention.

Referring now to FIG. 3, an image element antenna is shown which utilizes the present invention. The conventional single slot element 42 of FIG. 2 has been replaced by a compound element comprising a doublet of slots 52. The two slots are parallel and a distance d apart, thus producing a path difference L between the two rays 50. The condition for destructive interference between rays 50 with wavelength $\lambda$ is:

$$L=\lambda/2 \quad (1)$$

Simple trigonometry gives:

$$L=d \sin \theta b \quad (2)$$

Substitution into equation (1) yields:

$$d=\lambda/(2 \sin \theta b) \quad (3)$$

By spacing slots 52 according to equation (3), rays 50 are made to interfere destructively. Thus, despite the absence of multiple reflections at angle $\theta b$, there is a minimum of power radiated at the Brewster angle.

The compound elements of this invention are not limited to doublet elements. It is also possible to reduce the power radiated into sidelobes from a slot element by arranging parasitic elements near the slot. The compound element thus formed may take the form of a single driven slot radiator with two posts attached to the totally reflecting plane on opposite sides of the slot. Typical parasitic elements which may be used to form the compound elements of this invention are taught by U.S. Pat. No. 3,594,806, Dipole Augmented Slot Radiating Elements, July 20, 1971.

Figure 4A:
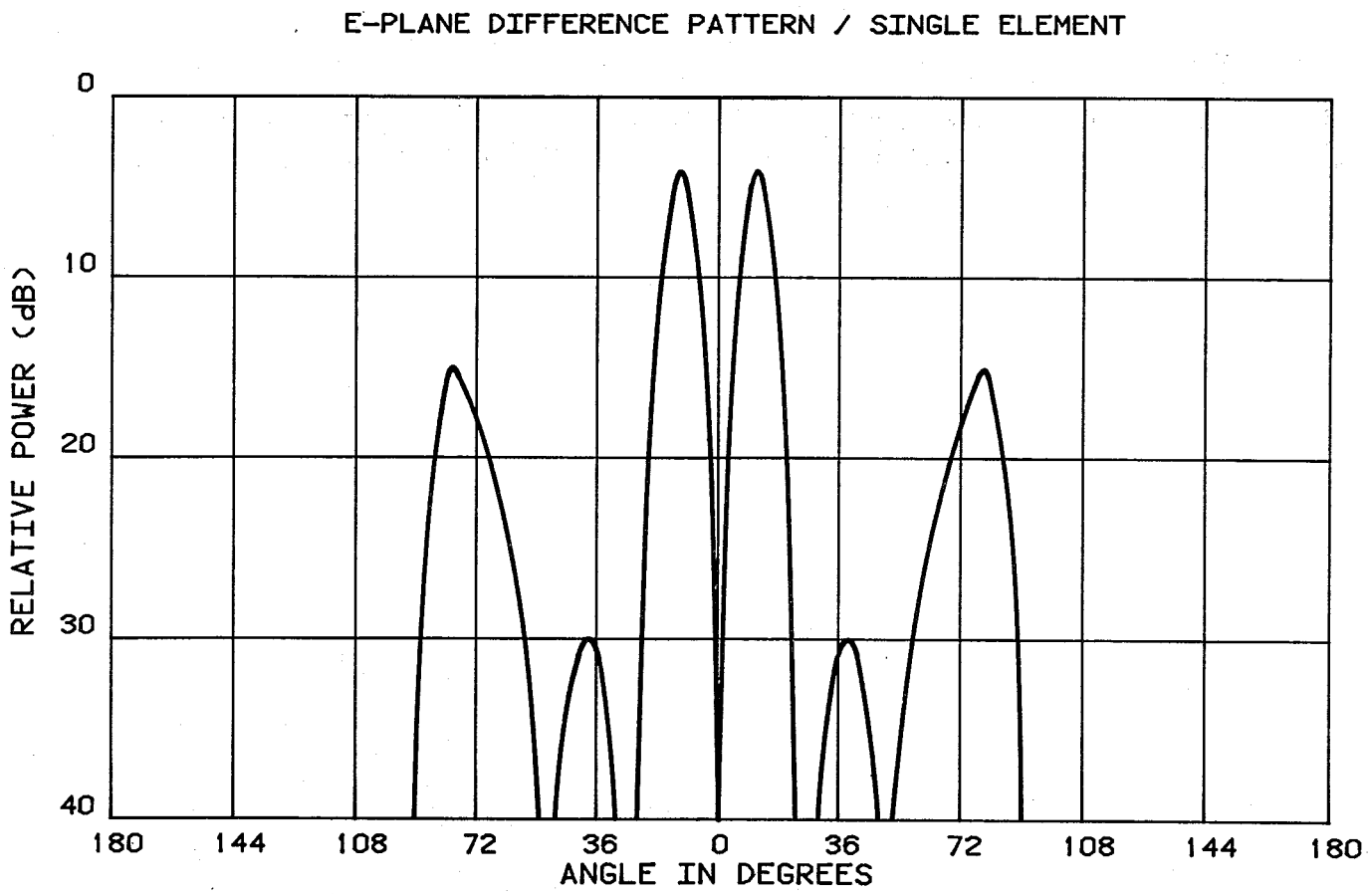
FIGS. 4A, 5A, 6A, and 7A are principal plane radiation patterns for a prior art image antenna.
Figure 4B:
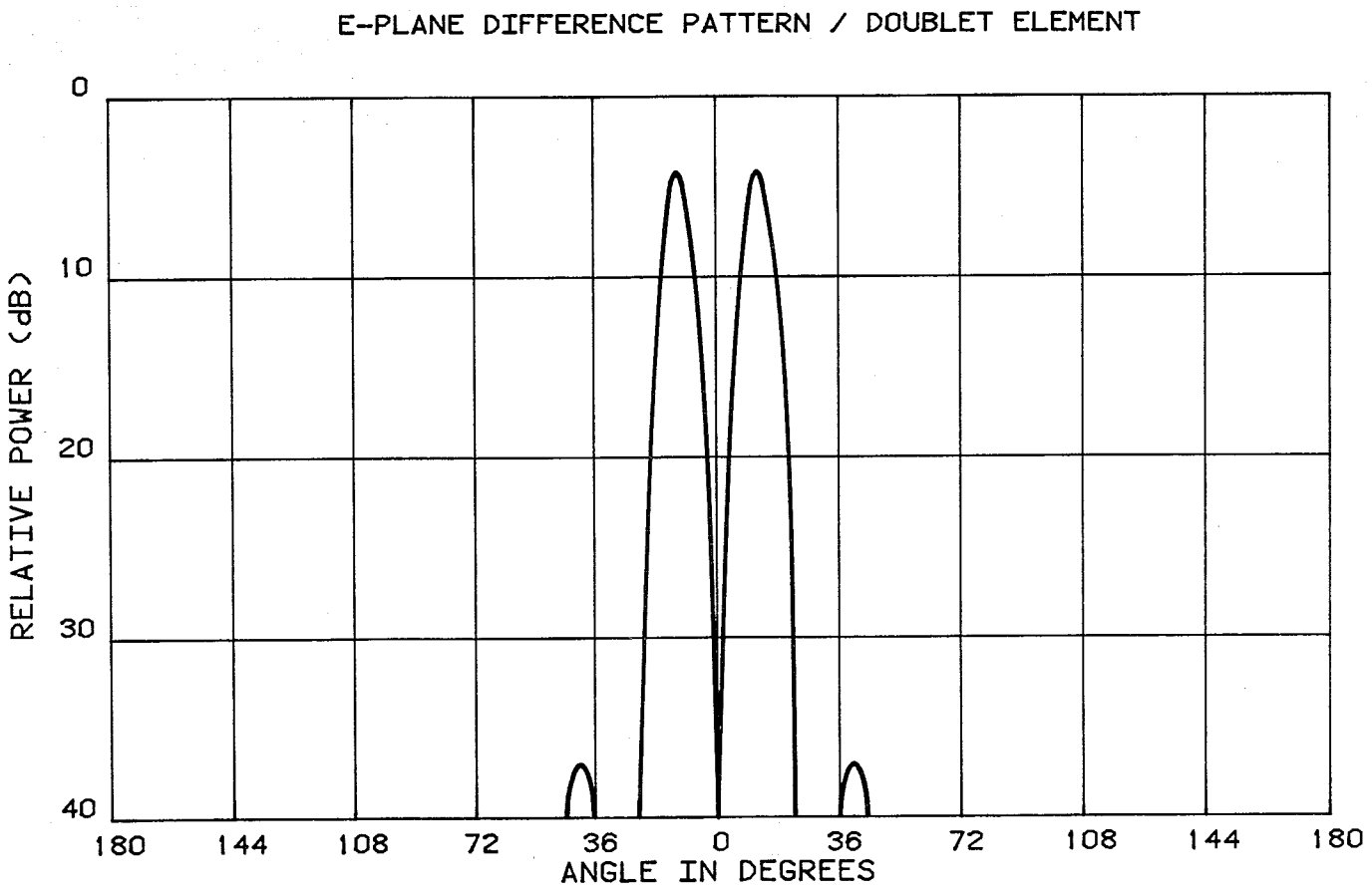
FIGS. 4B, 5B, 6B, and 7B are analogous patterns for an antenna utilizing the present invention.
Figure 5A:
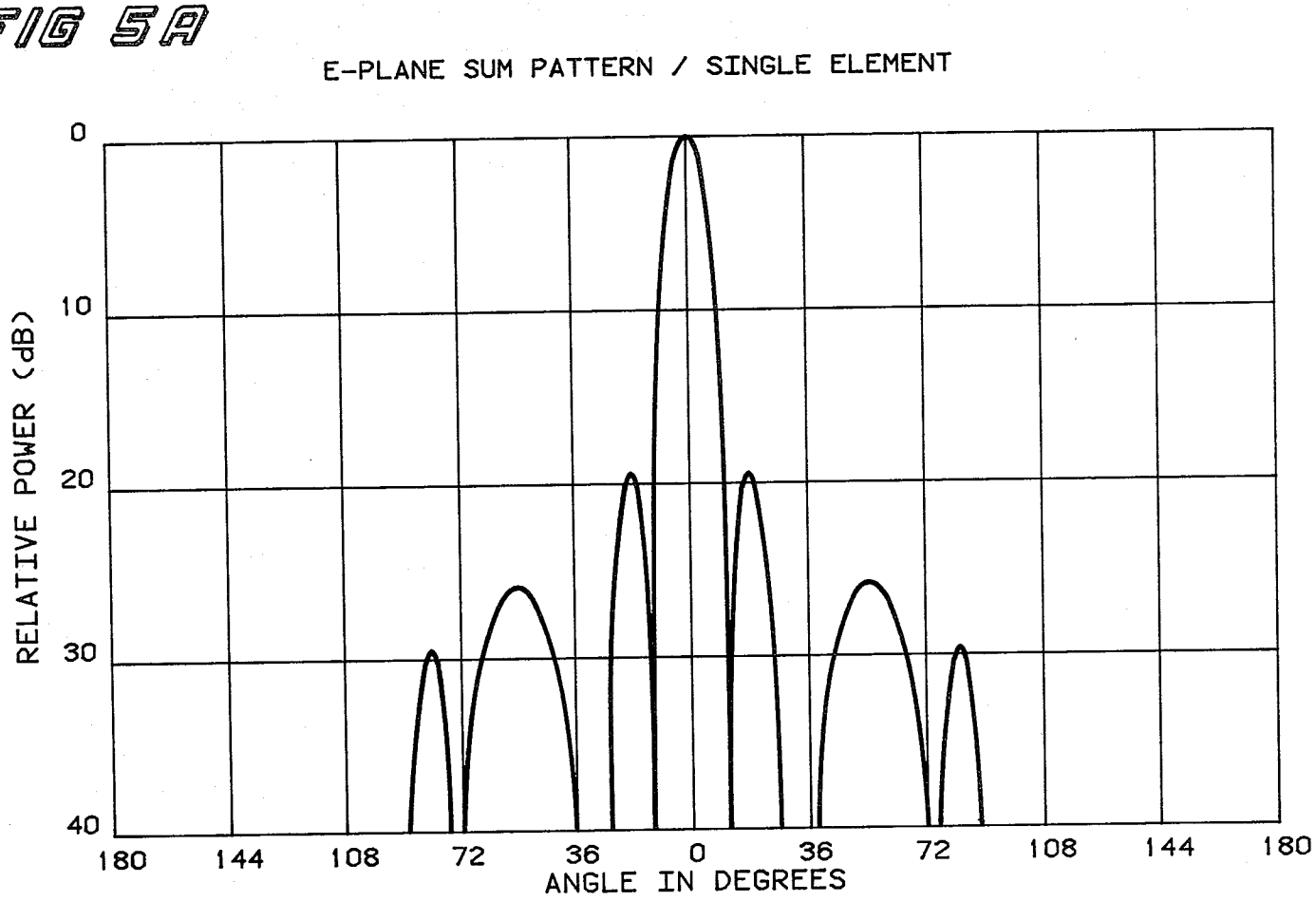
Figure 5B:
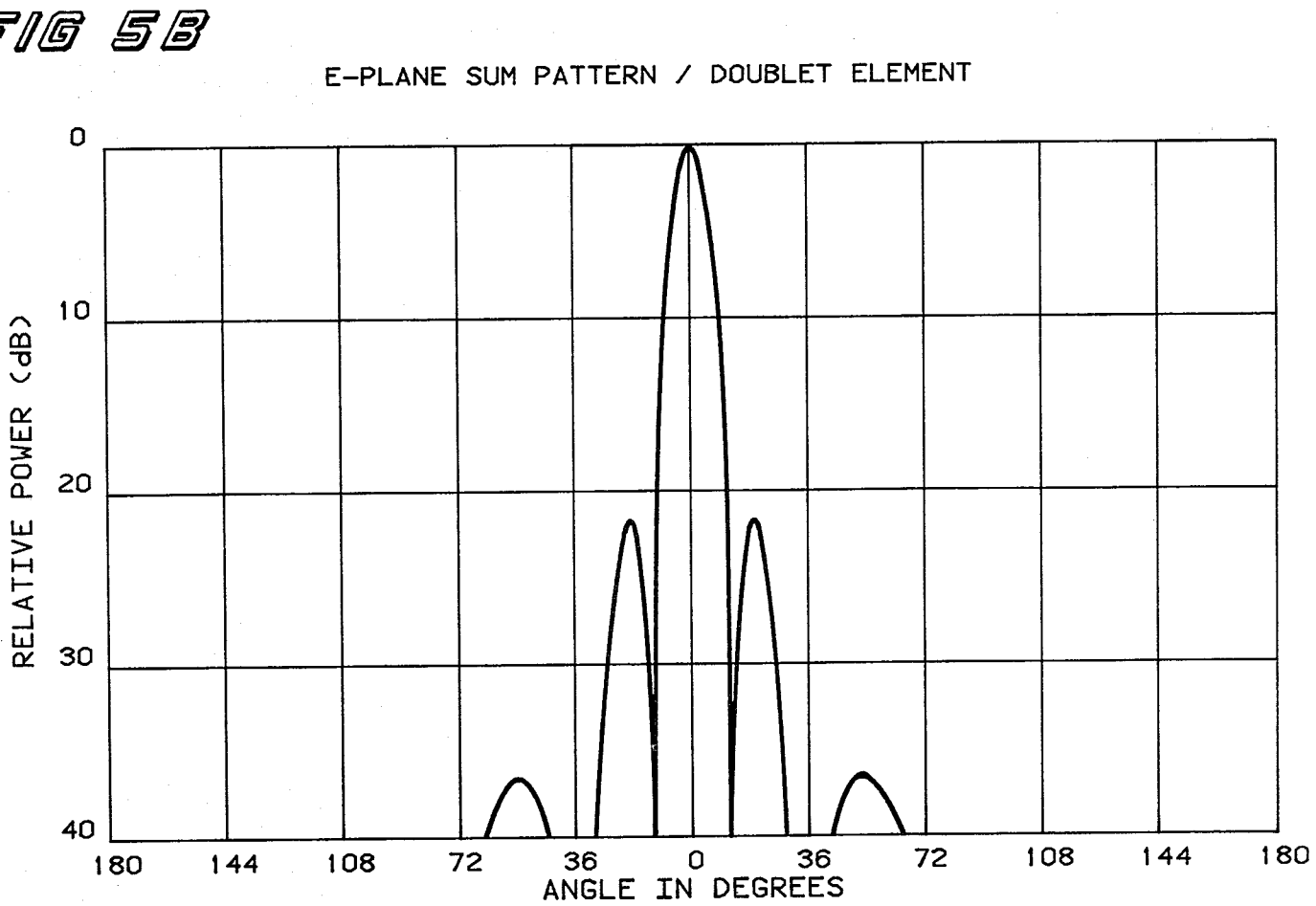
Figure 6A:
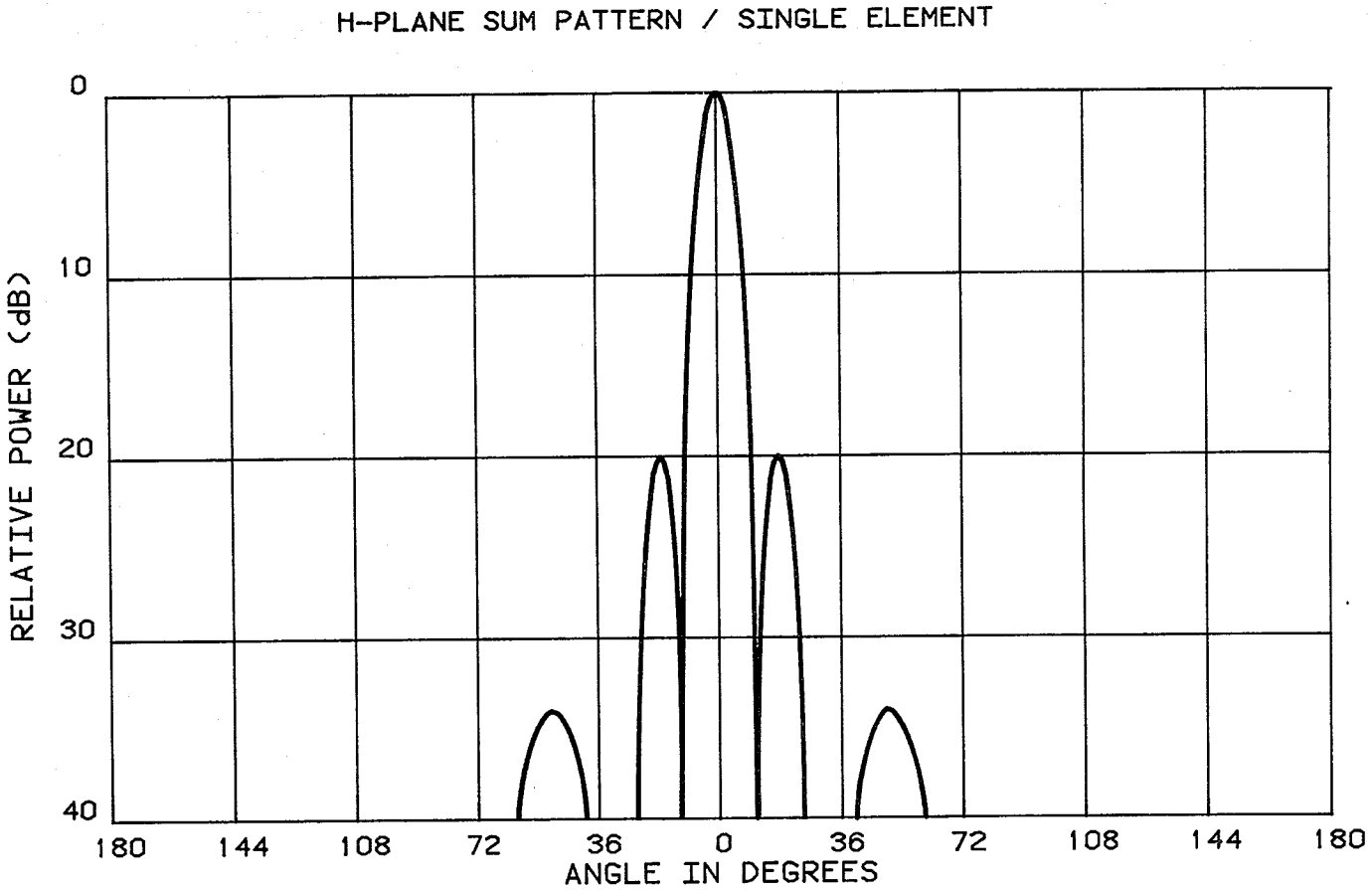
Figure 6B:
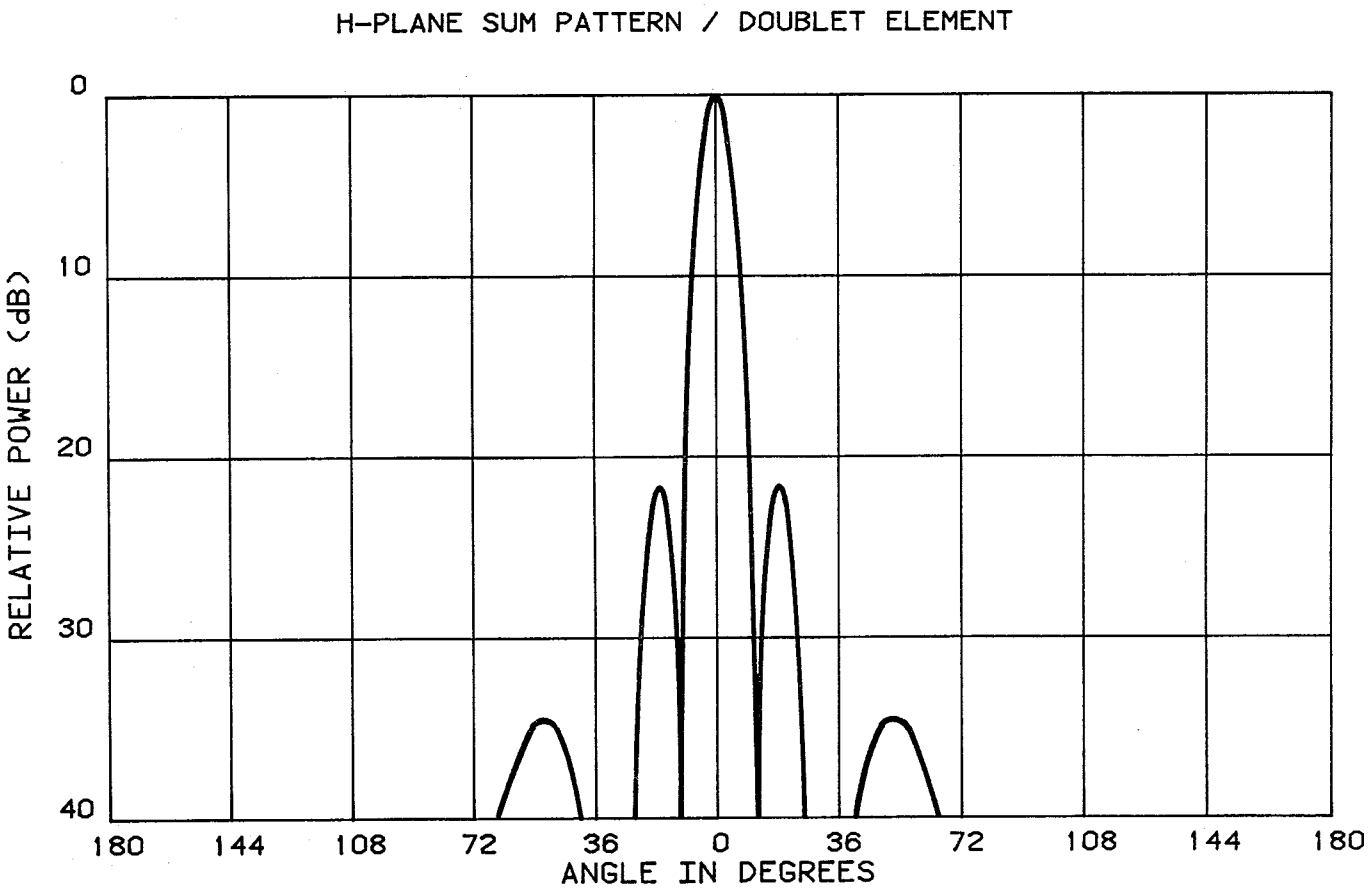
Figure 7A:
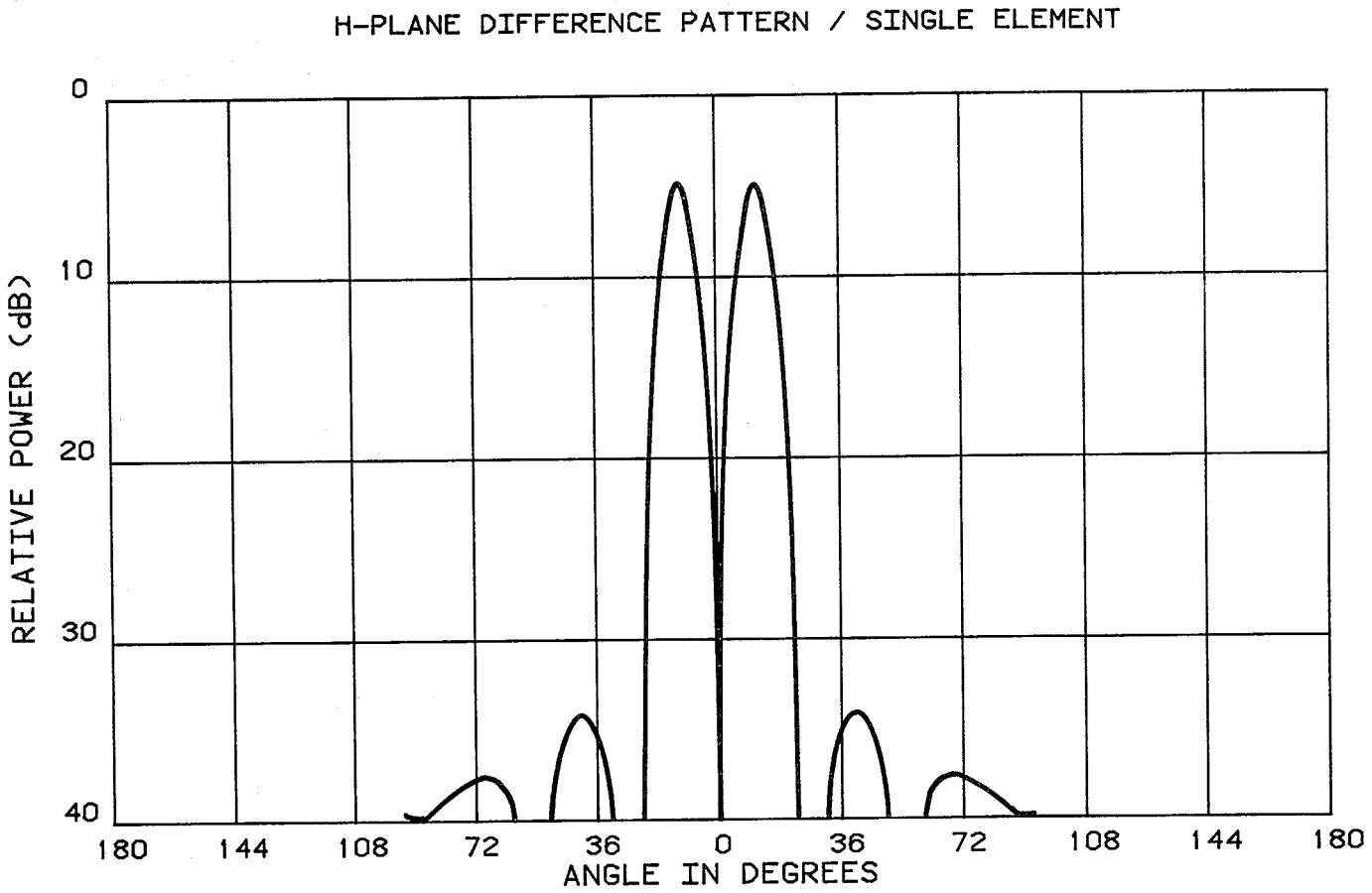
Figure 7B:
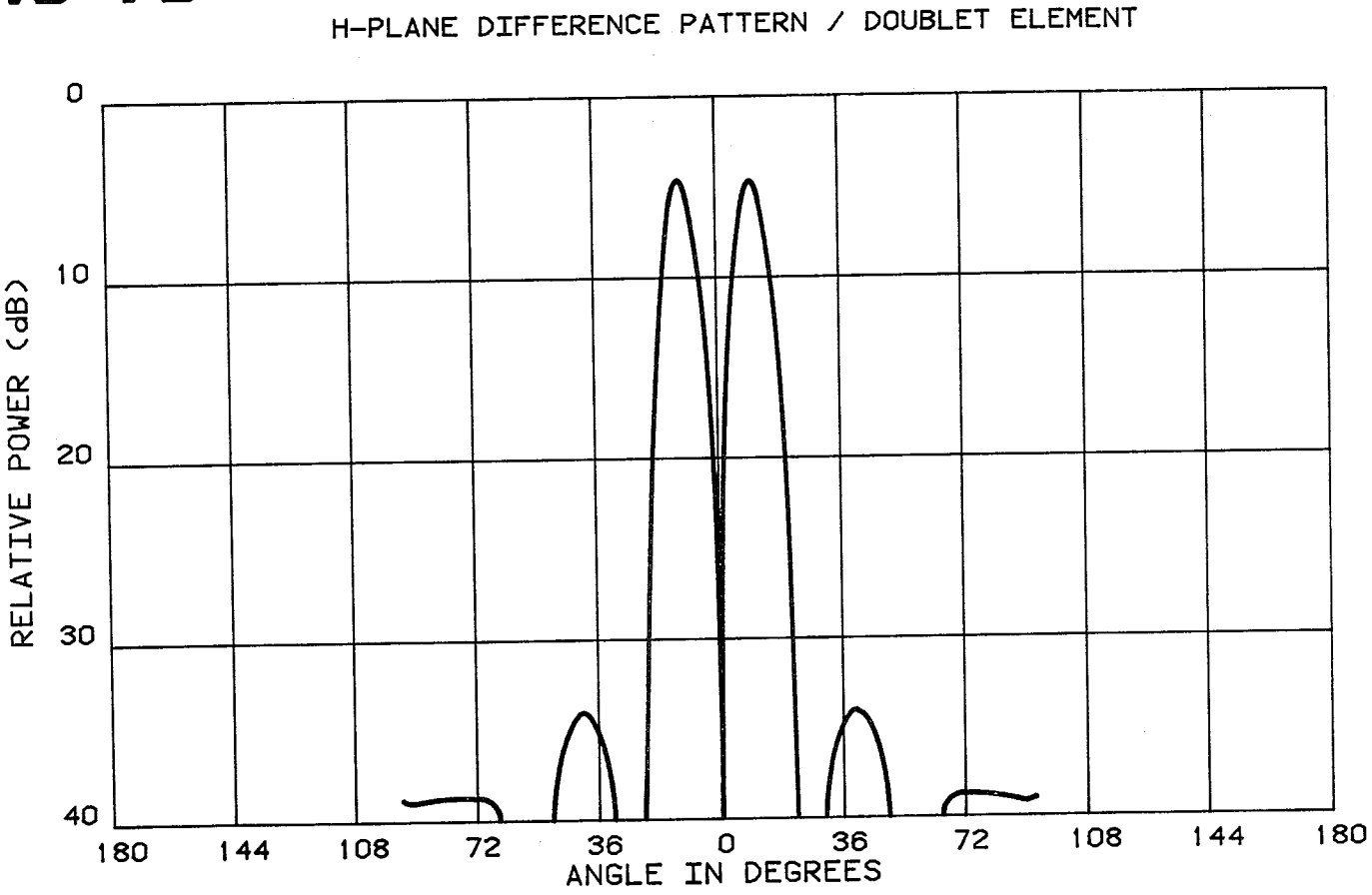
Figure 8:
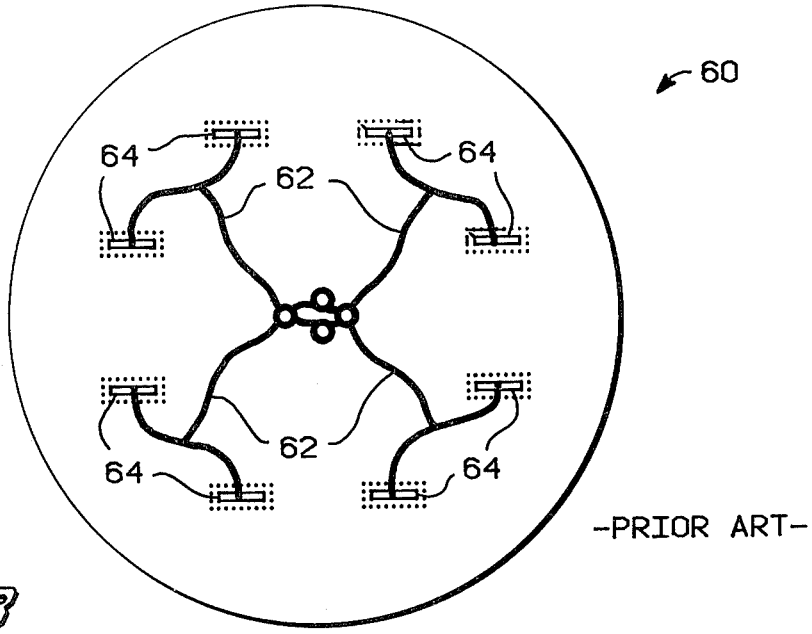
FIG. 8 shows an element array and feed network for a prior art image antenna.
Figure 9:
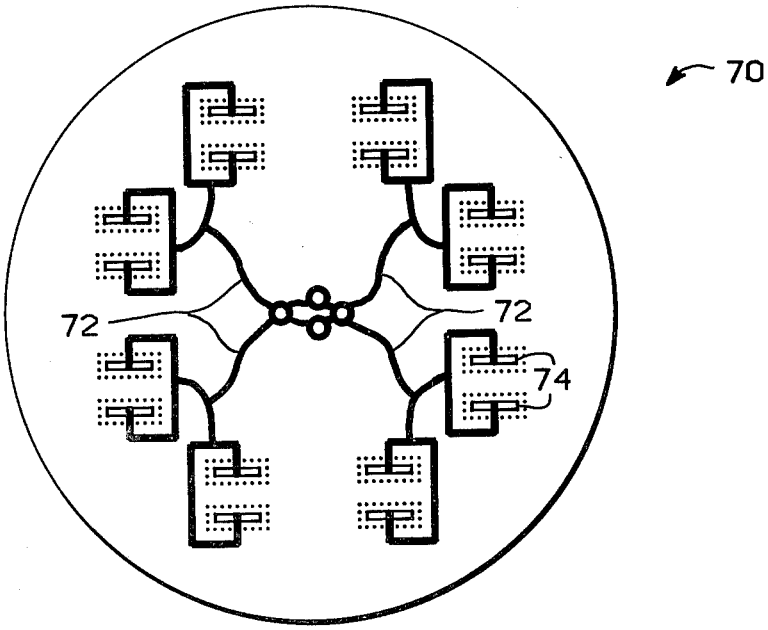
FIG. 9 shows an analogous array for an antenna utilizing the present invention.

FIGS. 4A–7B represent various radiation patterns for a practicl image element antenna. The antennas which these radiation patterns represent are of the type having multiple driven elements, examples of which are shown in FIGS. 8 and 9. FIGS. 4A and 4B represent the difference patterns in the E-plane for a prior art antenna and one utilizing the doublet elements of this invention, respectively. Comparison of the patterns demonstrates the improvement in directivity in the E-plane. The use of the terms difference pattern and sum pattern herein follows U.S Pat. No. 3,990,078. FIGS. 5A and B represent the E-plane sum patterns for the prior art antenna and the antenna of the present invention, respectively. Again, the large decrease in sidelobes is apparent. FIGS. 6A, 6B, 7A, and 7B represent the same patterns as described above except that these are the H-plane patterns. It is evident that the improvement in these patterns is less dramatic than for the E-plane patterns.

FIG. 8 shows a feed network and slot element array for a prior art antenna 60. Transmission lines 62 feed slots 64 in the manner described in U.S. Pat. No. 3,990,078. The design of the feed network and the use thereof to produce the sum and difference patterns is fully described in patent '078.

FIG. 9 shows an image element antenna 70 which utilizes the doublet elements of the preferred embodiment. For purposes of comparison, the antenna of FIG. 9 is designed precisely as that of FIG. 8 with the exception of the use of compound elements. Thus it can be seen that implementation of the present invention is accomplished with minimum redesign of existing antennas, yet produces the improvement in directivity shown in FIGS. 4A–7B. Each slot 64 (FIG. 8) of the prior art antenna is replaced with a doublet element comprising slots 74 spaced to radiate a minimium amount of energy at the Brewster angle defined by the wavelength of the energy and the material chosen for the partially reflecting plane. Feed network 72 is substantially similar to network 62 (FIG. 8), with the modifications necessary to feed each slot 75 of a doublet with energy of identical phase.

While the invention has been described with respect to a preferred embodiment, certain modifications will be obvious to those skilled in the art. These modifications are intended to be included in the scope of the invention.

What is claimed is:

1. An image element antenna for operating at a predetermined frequency comprising:

a partially reflecting plane having a known Brewster angle at said predetermined frequency;

a totally reflecting plane parallel to said partially reflecting plane, said partially reflecting plane and said totally reflecting plane defining a space therebetween;

at least one doublet element lying in said space, said doublet element comprising a pair of radiating elements spaced a distance d apart, where d is approximately equal to the wavelength corresponding to said predetermined frequency divided by twice the sine of said Brewster angle;

and means for feeding energy to and receiving energy from said at least one doublet element at said predetermined frequency.

2. In an image element antenna having a totally reflecting plane, a partially reflecting plane, and at least one antenna element, the improvement comprising: each said at least one element being a doublet element comprising a pair of radiating elements spaced a distance d apart, where d is approximately equal to an operating wavelength of said antenna divided by twice the sine of a Brewster angle of said partially reflecting plane.

3. An antenna comprising:

a partially reflecting plane having a known Brewster angle;

a totally reflecting plane, said totally reflecting plane being parallel to, and spaced from, said partially reflecting plane, thereby defining a space between said planes;

at least one doublet element comprising:

a pair of slot radiators in said totally reflecting plane, said slot radiators being spaced to radiate a minimum amount of energy at said Brewster angle;

and a feed network coupled to said at least one doublet element.

* * * * *